US008032052B2

(12) United States Patent
Ito

(10) Patent No.: US 8,032,052 B2
(45) Date of Patent: Oct. 4, 2011

(54) DEVELOPING DEVICE AND IMAGE FORMING APPARATUS

(75) Inventor: Junich Ito, Tokyo (JP)

(73) Assignee: Oki Data Corporation, Tokyo (JP)

( * ) Notice: Subject to any disclaimer, the term of this patent is extended or adjusted under 35 U.S.C. 154(b) by 647 days.

(21) Appl. No.: 11/863,305

(22) Filed: Sep. 28, 2007

(65) Prior Publication Data

US 2008/0080888 A1 Apr. 3, 2008

(30) Foreign Application Priority Data

Sep. 29, 2006 (JP) ..... 2006-268785

(51) Int. Cl.
*G03G 15/08* (2006.01)

(52) U.S. Cl. ..... 399/103; 399/105

(58) Field of Classification Search ..... 399/103, 399/105, 273, 274, 283, 284
See application file for complete search history.

(56) References Cited

U.S. PATENT DOCUMENTS 5,650,841 A * 7/1997 Matsuda et al. ..... 399/111
6,473,577 B1 * 10/2002 Higeta et al. ..... 399/109
6,721,520 B2 * 4/2004 Higeta et al. ..... 399/109
2006/0188286 A1 * 8/2006 Yuge ..... 399/102
2006/0251445 A1 * 11/2006 Ueno et al. ..... 399/102

FOREIGN PATENT DOCUMENTS

JP 2002-108089 4/2000

* cited by examiner

*Primary Examiner* — David Porta
*Assistant Examiner* — Faye Boosalis
(74) *Attorney, Agent, or Firm* — Panitch Schwarze Belisario & Nadel LLP

(57) ABSTRACT

A developing device containing a developer holding body for executing developing by affixing developer to an image support body, a controlling unit for thinning a layer of developer and disposed to contact the developer holding body, a support unit for supporting the controlling unit, an elastic sealing unit provided with a contact surface contacting the support unit and disposed on an edge side of the controlling unit, and a guiding unit for controlling an installation direction of a developing blade member at a time when the developing blade member is mounted on the elastic sealing unit, provided with a guiding surface formed at a prescribed angle in relation to the contact surface of the elastic sealing unit. The present invention attempts to prevent developer leakage from between a controlling unit and a sealing unit.

12 Claims, 19 Drawing Sheets

DEVELOPING DEVICE AND IMAGE FORMING APPARATUS

BACKGROUND OF THE INVENTION

1. Field of the Invention

The present invention relates to a developing device and an image forming apparatus.

2. Description of Related Art

In conventional image forming apparatuses such as printers, photocopiers, facsimile machines, and multifunction devices, for example, in printers, a surface of a photosensitive drum is charged with a charging roller and exposed with an LED head to form an electrostatic latent image, which is developed with a developing device thereafter, resulting in a toner image.

In the developing device, where toner serving as developer, which is thinly layered on a developing roller, is electrostatically attached thereto to form a toner image, the toner image is then transferred to a paper with a transfer roller, achieving image formation, in other words, executing printing. The toner remaining on the photosensitive drum after the transfer operation is removed with a cleaning device.

The developing roller is provided with a developing blade as a restricting member for restricting a toner layer supplied to the developing roller by bringing a front end of the developing blade in contact with the developing roller, and sealing units for preventing toner from leaking from at both end sides of a toner supply roller for supplying the developing roller with the toner by bringing both ends of the toner supply roller in contact with both ends of the developing blade member. An example of related art is Japanese Patent Application Publication No. 2002-108089.

In the conventional developing device, however, the sealing units are provided in contact with both ends of the developing blade member, thereby being sometimes curled up by the developing blade member during assembly of the developing blade member, resulting in gaps between the developing blade member and the sealing units, from which the toner undesirably leaks.

BRIEF SUMMARY OF THE INVENTION

An object of this invention is to solve problems with the above developing device and to provide a developing device and an image forming apparatus for preventing developer from leaking from gaps between the restricting member and the sealing units.

The developing device of the present invention contains a developer carrier for executing developing by affixing developer to an image carrier, a restricting section disposed in contact with the developer carrier for thinning a layer of developer, a support section for supporting the restricting section, an elastic sealing section provided with a contact surface contacting the support section and disposed on an edge side of the restricting section, and a guiding section for restricting an installation direction of a developing blade member at a time when the developing blade member is mounted on the elastic sealing section provided with a guiding surface formed at a prescribed angle in relation to the contact surface of the elastic sealing section.

In this case, because the guiding section is provided with a guiding surface formed at a prescribed angle in relation to the contact surface of the elastic sealing section to restrict the installation direction at a time when the developing blade member is installed on the elastic sealing section, the edge of the elastic sealing section is not curled up by the edge of the support section. Accordingly, a gap between the support section and the sealing section and between the restricting section and the sealing section can be prevented, thereby preventing developer leakage.

BRIEF DESCRIPTION OF THE SEVERAL VIEWS OF THE DRAWINGS

This invention may take physical form in certain parts and arrangements of parts, a preferred embodiment and method of which will be described in detail in this specification and illustrated in the accompanying drawings which form a part hereof, and wherein.

DESCRIPTION OF PREFERRED EMBODIMENTS

First Embodiment

Hereinafter, embodiments of the present invention will be described in detail with reference to drawings. In this case, a color printer categorized as an image forming apparatus is described.

Figure 2:
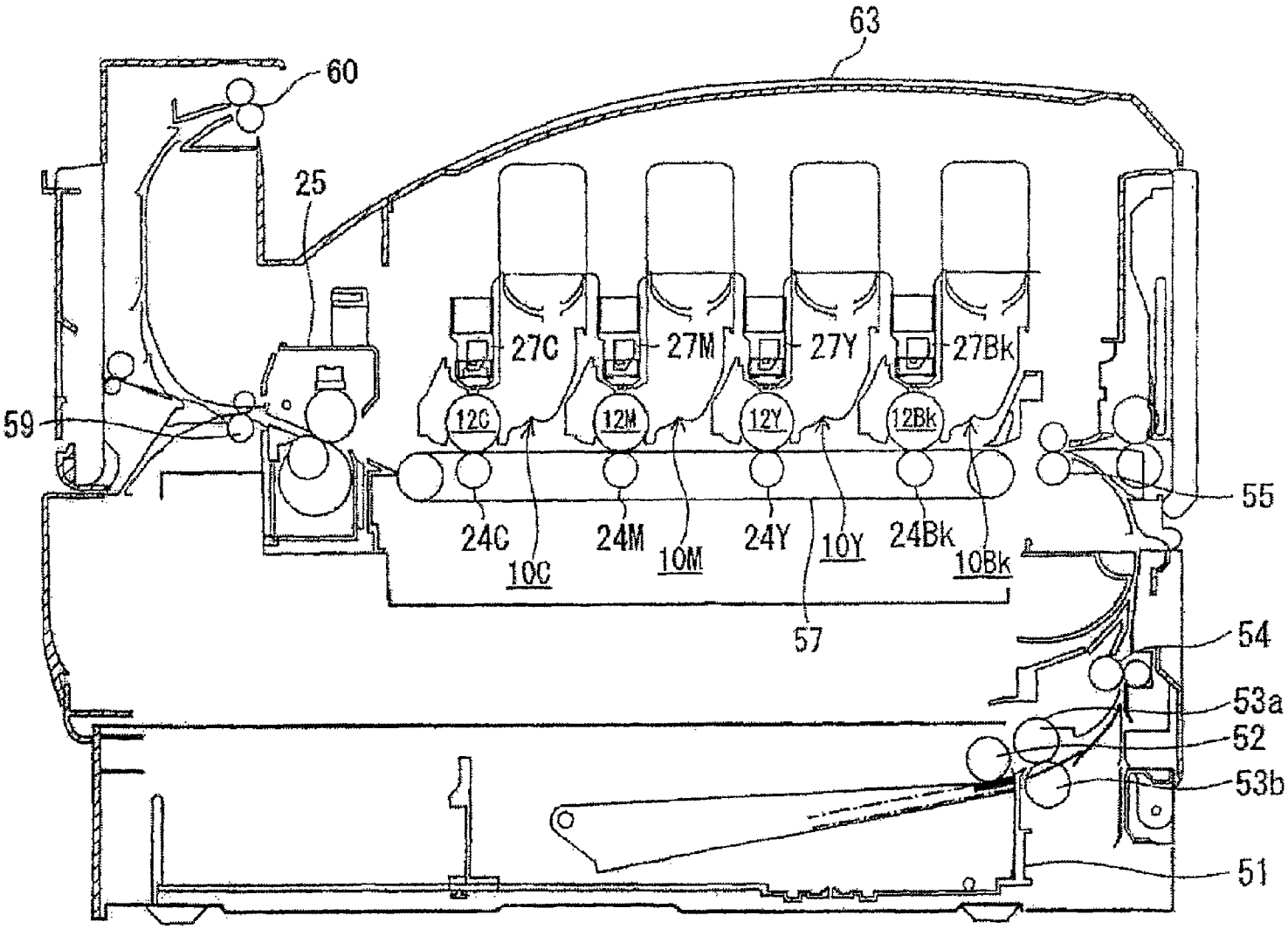
FIG. 2 is a schematic view of a printer according to the first embodiment of the present invention.

FIG. 2 is a schematic view of a printer according to the present invention,

As shown in FIG. 2, the printer is provided with a paper feeding cassette 51 functioning as a medium container for containing therein papers as a recording medium, not shown, at a bottom of a main body. The printer is provided with a paper feeding system functioning as a medium supplier for feeding the papers by separating them one by one, in a manner that the paper feeding system is adjacent to a front end of the paper feeding cassette 51. The paper feeding system includes a separation roller 52 and paper feeding rollers 53*a*, 53*b*. The paper is fed with the paper feeding system to conveyance rollers 54, 55 arranged above the paper feeding system. The paper is then conveyed with a conveyance belt 57 as a conveyer in accordance with driving the conveyance belt 57 to a plurality of developing devices 10Bk, 10Y, 10M, 10C for forming images in black, yellow, magenta, and cyan, respectively. At the developing devices 10Bk, 10Y, 10M, 10C, the paper is passed between photosensitive drums 12Bk, 12Y, 12M, 12C serving as image carriers provided to developing devices 10Bk, 10Y, 10M, 10C, and transfer rollers 24Bk, 24Y, 24M, 24C serving as transfer members. The transfer toner images in different colors formed on the photosensitive drums 12Bk, 12Y, 12M, 12C, respectively, are transferred by the transfer rollers 24Bk, 24Y, 24M, 24C one after another to the paper to form a colored toner image thereon.

Subsequently, the paper is conveyed to a fuser 25 functioning as a fusing device, with which the colored toner image is fused onto the paper to form a colored image. The paper discharged from the fuser 25 is conveyed with a conveyance roller 59 and thereafter discharged with a discharge conveyance roller 60 to an outside of the main body, thereby being stacked on a top cover 63 functioning as a medium stacker.

LED heads 27Bk, 27Y, 27M, 27C serving as exposure devices are provided in a manner to face the photosensitive drums 12Bk, 12Y, 12M, 12C, respectively, to expose surfaces of the photosensitive drums 12Bk, 12Y, 12M, 12C in order to form electrostatic static images as a latent image.

The top cover 63 is provided to a top of the main body in an openable and closable manner so that the developing devices 10Bk, 10Y, 10M, 10C are provided to the main body in a detachable and attachable manner. Each of the LED heads 27Bk, 27Y, 27M, 27C is held by the top cover 63.

Next, the developing devices 10Bk, 10Y, 10M, 10C will be described. The developing devices 10Bk, 10Y, 10M, 10C all have the same structure, so that only the developing device 10Bk is explained while explanation of the other developing devices 10Y, 10M, 10C is omitted.

Figure 3:
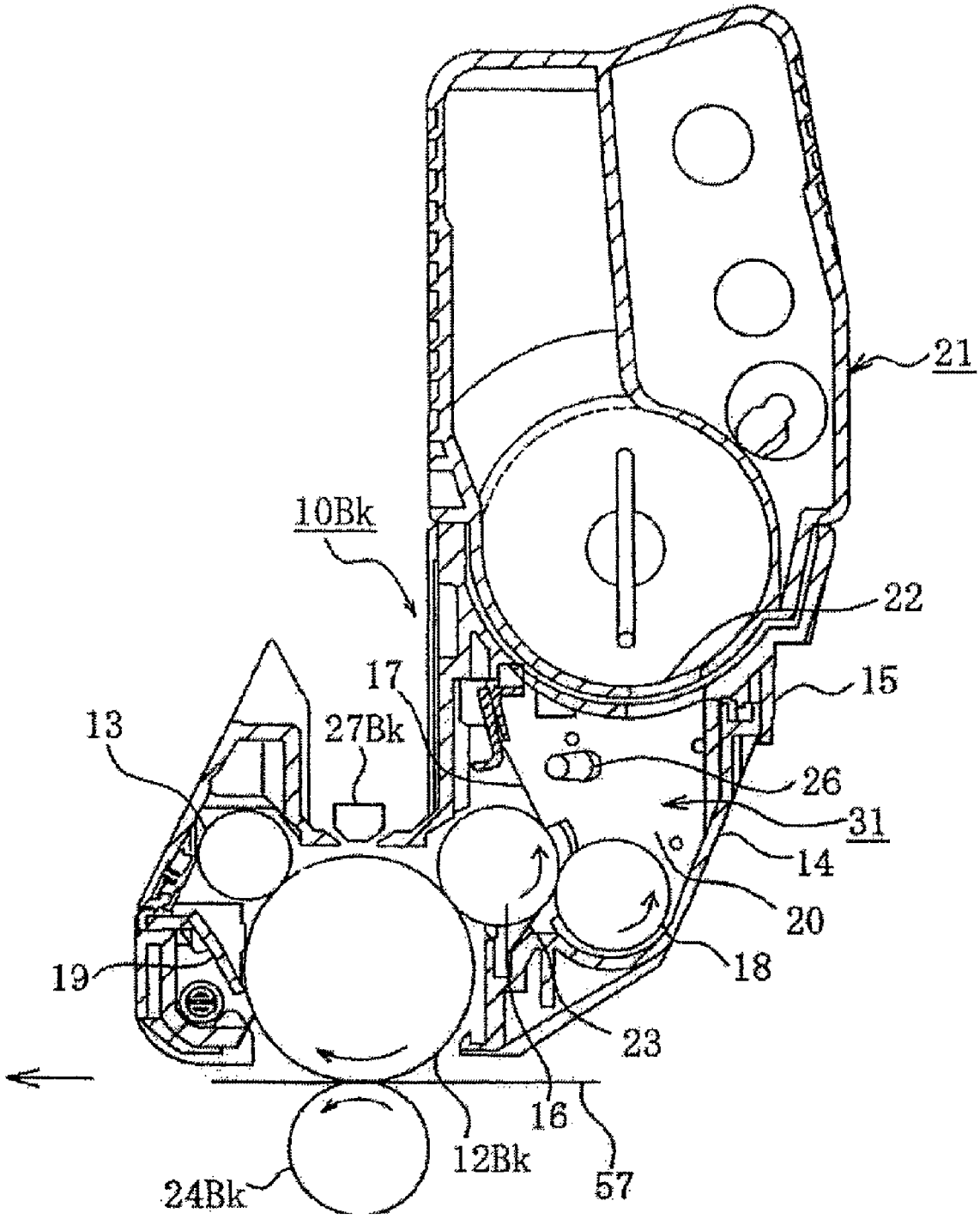
FIG. 3 is a cross-sectional view of essential parts of a developing device according to the first embodiment of the present invention.

FIG. 3 is a cross-sectional view showing essential elements of the developing device according to a first embodiment of the present invention.

The developing device 10Bk includes the photosensitive drum 12Bk; a charging roller 13 functioning as a charging device, disposed in contact with the photosensitive drum 12Bk, and charging a surface of the photosensitive drum 12Bk equally and uniformly; a developing roller 16 functioning as a developer carrier, disposed in contact with the photosensitive drum 12Bk, holding toner as developer, not shown, performing development by attaching the toner to the photosensitive drum 12Bk in accordance with self-rotation, and forming a toner image by developing an electrostatic latent image; a supplying roller 18 functioning as a supplying member, disposed in contact with the developing roller 16, and supplying toner to the developing roller 16; a developing blade 17 functioning as a restricting member, disposed in a manner to have a front end in contact with the developing roller 16, and layering the toner thinly and uniformly, the toner having been supplied onto the developing roller 16; a cleaning unit (a cleaning blade) 19 functioning as a cleaning device for removing the toner remaining at the photosensitive drum 12Bk after transfer of the toner image; an agitating bar 26 for agitating the toner inside a storage chamber 20; and the like. A film 23 made from thermoplastic urethane in a belt-shape for sealing purpose is arranged in a manner to vertically extend in contact with the developing roller 16 so that the toner inside the storage chamber 20 does not leak to a side of the photosensitive drum 12Bk. The developing roller 16, the supplying roller 18, and the developing blade 17 compose a developing unit. Numeral 57 is the conveyance belt.

The developing device 10Bk includes a developing device main body and a toner cartridge 21 functioning as a developer cartridge containing the toner disposed in a detachable and attachable manner with respect to the developing device main body. An opening 22 is formed in a bottom wall of the toner cartridge 21, through which the toner flows down from the toner cartridge 21. The developing device main body stores the supplied toner in the storage chamber 20. The LED head 27Bk is arranged above the photosensitive drum 12Bk outside the developing device 10Bk while a transfer roller 24Bk is arranged below the photosensitive drum 12Bk.

The developing device main body includes a base frame 14 as a first case and an upper frame 15 as a second case. The base frame 14 supports the photosensitive drum 12Bk, the charging roller 13, the developing roller 16, the cleaning unit 19, and the like. The film 23 is mounted to a bottom surface of the base frame 14 with a double-face adhesive tape, not shown, intervened therebetween in a manner that the film 23 is in contact with a bottom portion of the developing roller 16. A supplying roller assembly 31 including the supplying roller 18, the agitating bar 26, and the like is mounted to a side surface of the base frame 14.

In the developing device 10Bk with the structure described above, the developing roller 16 and the supplying roller 18 are rotated in a counterclockwise direction (a direction indicated by an arrow) during printing operation by a driving motor, not shown, as a driving unit for supplying the developer, so that the supplying roller 18 supplies the developing roller 16 with the toner. The toner supplied to the developing roller 16 is conveyed in accordance with rotation of the developing roller 16 to a contact area between the developing roller 16 and the developing blade 17. Subsequently, the developing blade 17 sweeps away the extra toner to leave a thin layer of toner, and the thinly layered toner is then conveyed to the photosensitive drum 12Bk in accordance with rotation of the developing roller 16.

On the other hand, the photosensitive drum 12Bk is rotated in a clockwise direction (a direction indicated by an arrow) by driving a drum motor, not shown, as a driving unit for forming images. In accordance with rotation of the photosensitive drum 12, the surface of the photosensitive drum 12Bk is charged equally and uniformly by the charging roller 13 and exposed by the LED head 27Bk to form an electrostatic latent image. The toner on the developing roller 16 is then attached electrostatically to the electrostatic latent image, thereby forming a toner image.

Described next is an assembly process of the developing device 10Bk having the structure described above.

Figure 4:
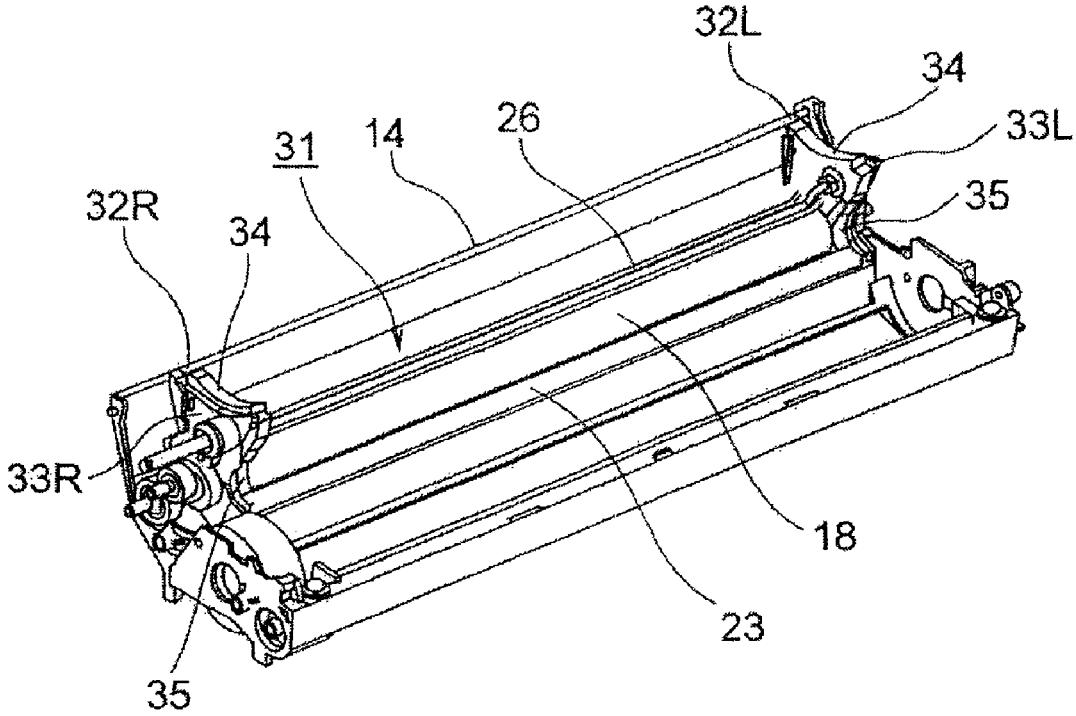
FIG. 4 is a first view showing steps for assembling the developing device according to the first embodiment of the present invention.
Figure 5:
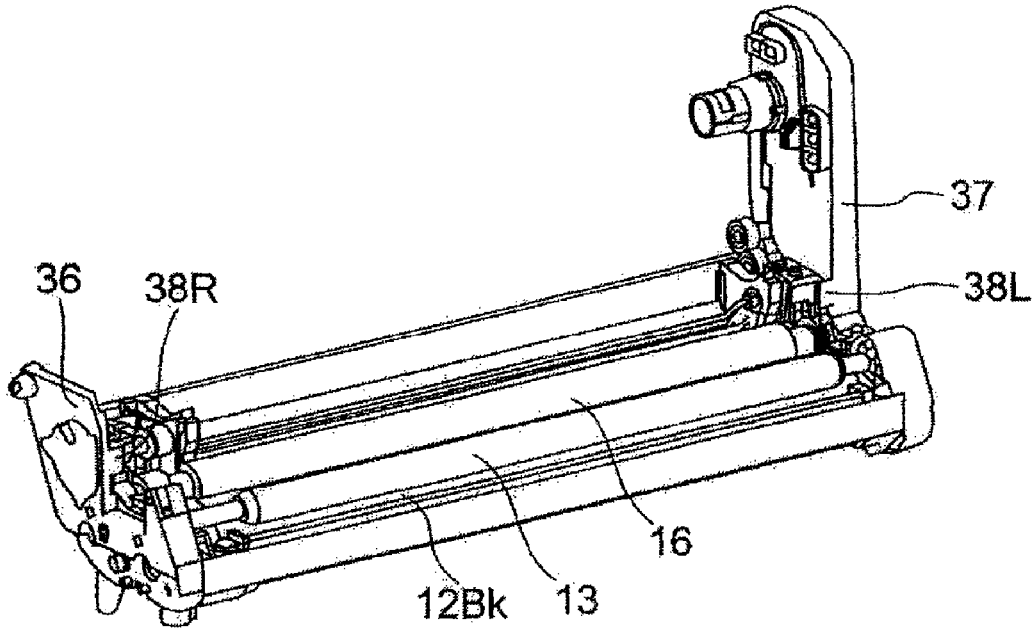
FIG. 5 is a second view showing steps for assembling the developing device according to the first embodiment of the present invention.
Figure 6:
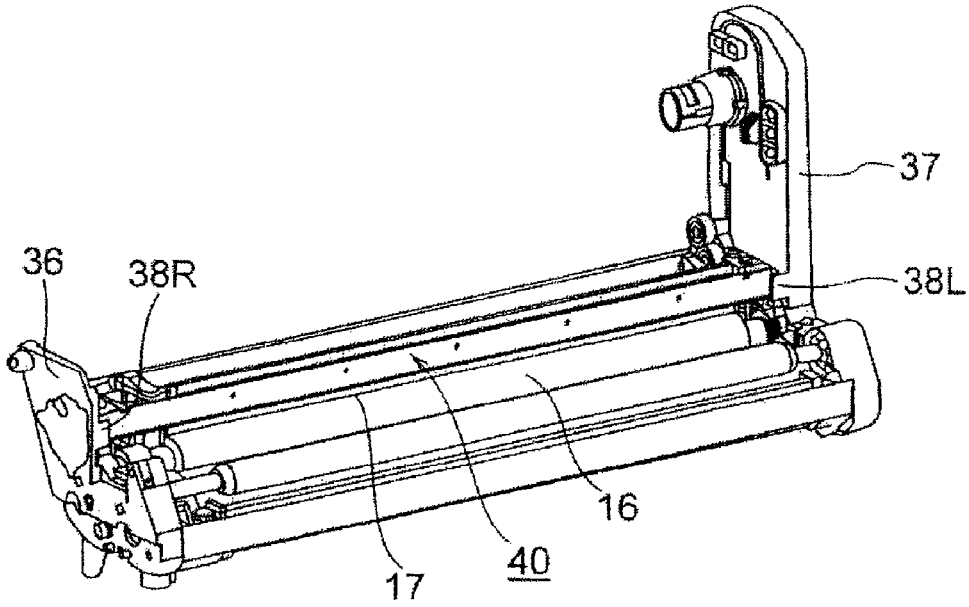
FIG. 6 is a third view showing steps for assembling the developing device according to the first embodiment of the present invention.
Figure 7:
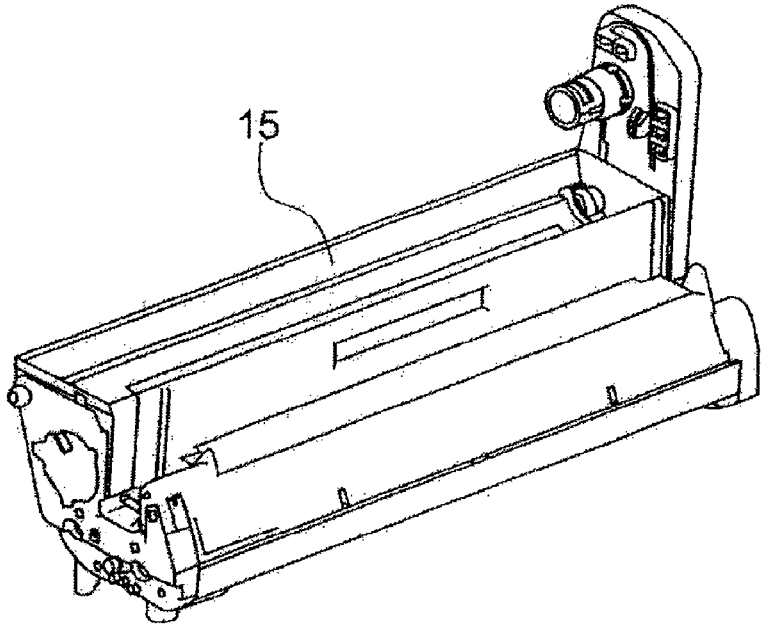
FIG. 7 is a fourth view showing steps for assembling the developing device according to the first embodiment of the present invention.

FIG. 4 is a first view showing the assembly process of the developing device according to the first embodiment of this invention. FIG. 5 is a second view showing the assembly process of the developing device according to the first embodiment of this invention. FIG. 6 is a third view showing the assembly process of the developing device according to the first embodiment of this invention. FIG. 7 is a fourth view showing the assembly process of the developing device according to the first embodiment of this invention.

As shown in FIG. 4, the supplying roller assembly 31 is placed on the base frame 14. The supplying roller assembly 31 is composed of the supplying roller 18, the agitating bar 26, and sealing plates 33L, 33R made of resin for protecting sealing units 32L, 32R of the developing device 10Bk, which are arranged on left and right sides, respectively, with respect to a paper conveyance direction. The sealing units 32L, 32R are composed of side sponges 34 made of urethane foam serving as an elastic sealing material in contact with both ends of the supplying roller 18 and of felt sponges 35 in contact with both ends of the developing roller 16. The felt sponges 35 are such that felt is adhered to a surface in contact with the development roller 16, that is, a contacting surface, while the urethane foam portion at an opposite surface is secured to a circular surface of the sealing plates 33L, 33R.

Next, as shown in FIG. 5, the photosensitive drum 12Bk and the charging roller 13 are placed, and the developing roller 16 is placed between the photosensitive drum 12Bk and the supplying roller 18. The developing roller 16 is brought into contact with the film 23 disposed therebelow and the felt sponges 35 at both ends to prevent leaking of the toner from corresponding portions.

Side frames 36, 37 are then inserted to position each roller by holding an axle of each roller from both ends.

Subsequently, as shown in FIG. 6, a developing blade member 40, provided with the developing blade 17 and serving as a restricting member, is guided along guides 38L, 38R serving as guiding members and formed in a unified manner with the side frames 36, 37. The developing blade member 40 is then affixed and assembled. The guides 38L, 38R are arranged in a pair facing each other and compose the first and second members to guide both ends of the developing blade element 40.

Therefore, the developing roller 16 and the developing blade 17 are in contact with each other, and the developing blade element 40 and the sealing units 32L, 32R are in contact with each other at both ends, so that a sealed storage chamber 20 (FIG. 3) is formed. The guides 38L, 38R function as direction restricting members to regulate an direction at which the developing blade member is installed at a time when the developing blade member is installed between the side sponges 34.

Finally, as shown in FIG. 7, an upper frame 15 having an opening is placed on top, and the toner cartridge 21 is then affixed to complete assembly of the developing device 10Bk.

The following is a description of the developing blade member 40.

Figure 8:
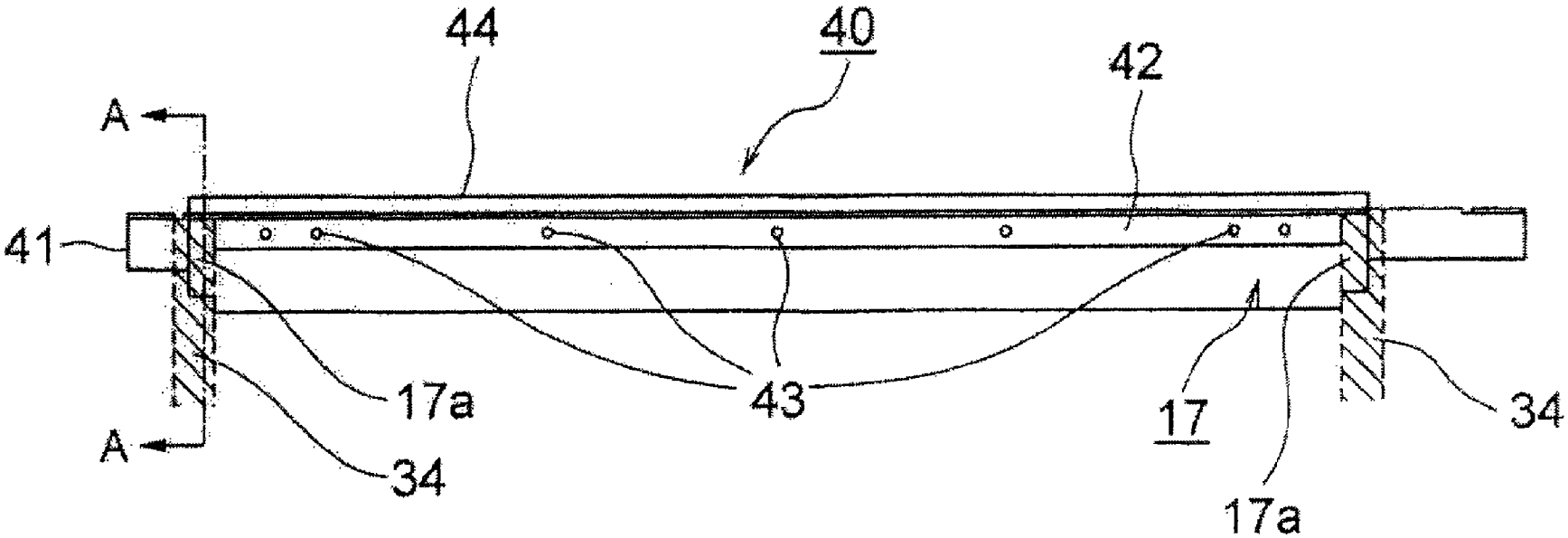
FIG. 8 is an elevational view of a developing blade member according to the first embodiment of the present invention.
Figure 9:
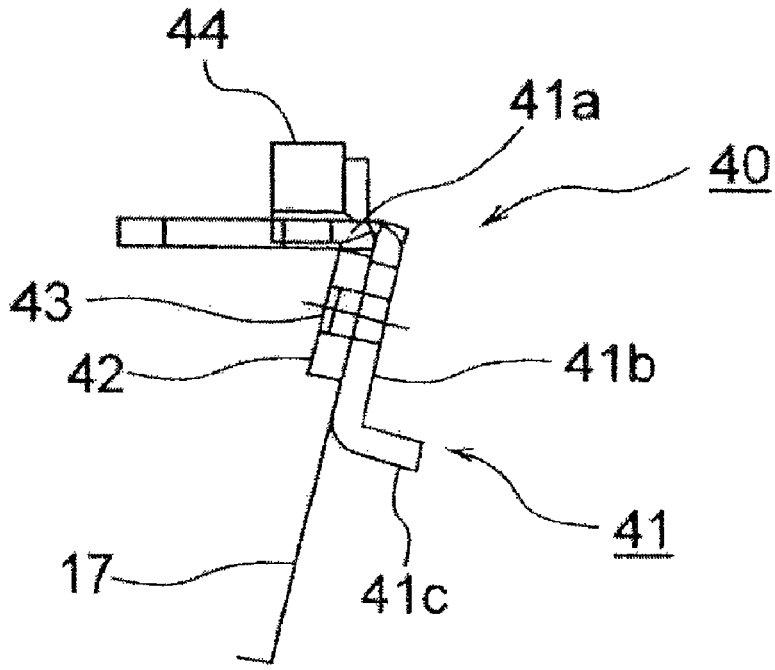
FIG. 9 is a side view of the developing blade member according to the first embodiment of the present invention.
Figure 10:
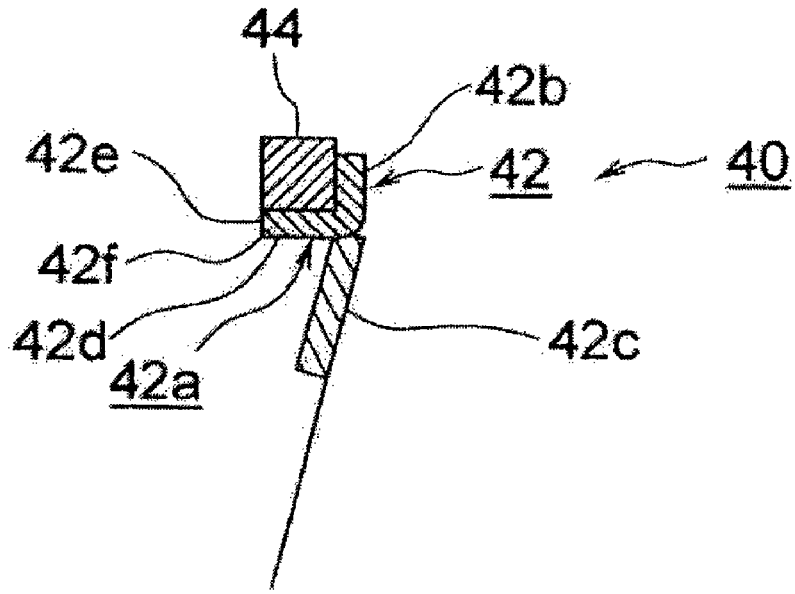
FIG. 10 is a cross-sectional view taken along a line A-A of FIG. 8.

FIG. 8 is a front view of the developing blade element according to the first embodiment of the present invention. FIG. 8 is a side view of the developing blade element according to the first embodiment of the present invention. FIG. 10 is a cross-sectional view taken along the line A-A of FIG. 8.

As shown in FIG. 8, the developing blade member 40 is provided with the developing blade 17 and a developing blade support unit 41 and a plate 42 for supporting the developing blade 17 from above, such that the a supporting element is formed by the developing blade support unit 41 and the plate 42. The developing blade 17 is formed of a thin plate and is sandwiched between the developing blade support unit 41 and the plate 42 and is secured by screws 43. A sponge 44, serving as an elastic member for preventing toner leakage, is affixed to a top surface of the plate 42 by double-face adhesive tape serving as an adhesive member.

The developing blade support unit 41 is provided with a horizontal unit 41*a* as a first member extending horizontally, a downwardly extending unit 41*b* as a second member extending obliquely backwards from the horizontal unit 41*a*, and a guided unit 41*c* as a third member, extending almost horizontally from the downwardly extending unit 41*b*, a tip thereof coming into contact with the guide 38L at a time when the developing blade member 40 is guided along the guide 38L formed on the side frame 37 (FIG. 5).

The plate 42 is provided with a bottom unit 42*a* as a first member extending horizontally, an upright unit 42*b* as a second member formed standing upright from a front edge of the bottom unit 42*a*, and a downwardly extending unit 42*c* as a third member extending downward from the front edge of the bottom unit 42*a*. The developing blade 17 is sandwiched between the downwardly extending units 41*b*, 42*c*.

The bottom unit 42*a*, to position the plate 42 against the side sponges 34, is provided with a bottom surface 42*d* as a first surface, a side surface 42*e* as a second surface, and a ridge line 42*f* at a corner between the bottom surface 42*d* and the side surface 42*e*. Therefore, the plate 42 is positioned against the side sponges 34 and both ends 17*a* of the developing blade 17 are brought into contact with a surface of the side sponges 34.

The following is a description of the sealing unit 32L. The sealing units 32L, 32R each have the same structure, and therefore the sealing unit 32L is described while a description of the sealing unit 32R is omitted.

Figure 11:
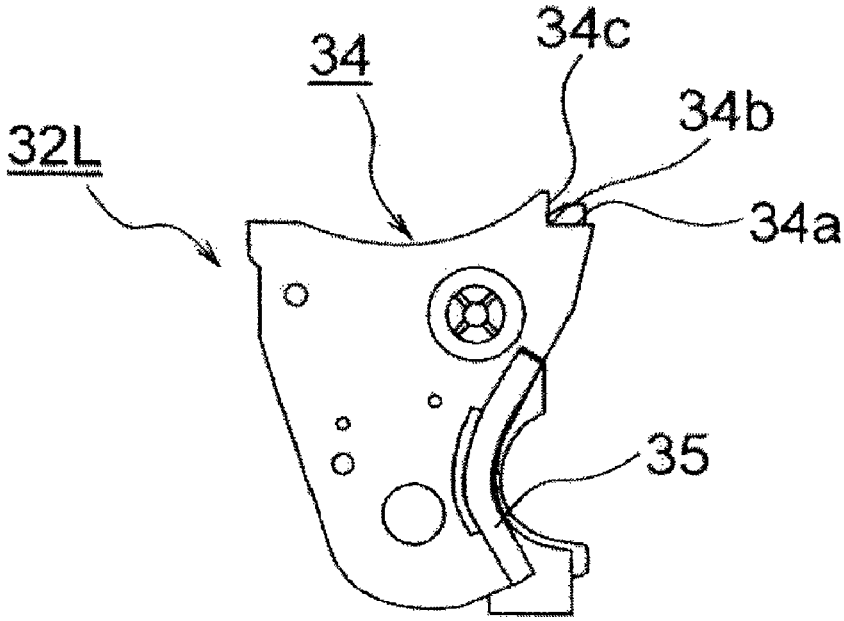
FIG. 11 is a side view of a sealing unit according to the first embodiment of the present invention.
Figure 12:
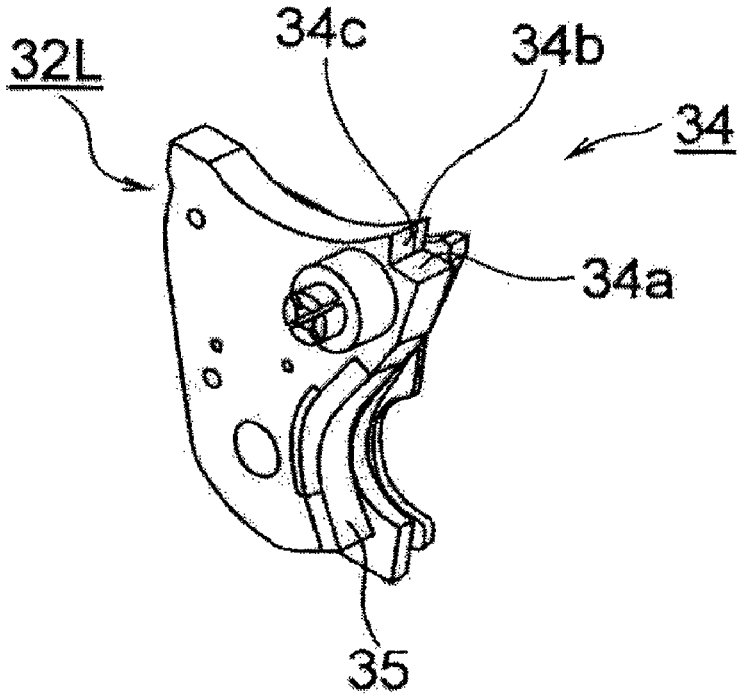
FIG. 12 is a perspective view of the sealing unit according to the first embodiment of the present invention.

FIG. 11 is a lateral view of the sealing unit according to the first embodiment of the present invention. FIG. 12 is a perspective view of the sealing unit according to the first embodiment of the present invention.

As shown in FIG. 11, the sealing unit 32L is provided with the side sponge 34 and the felt sponge 35. The side sponge 34 is provided with a notch on an upper portion at an end portion of a downstream side in a conveyance direction of the paper. Formed in the notch are a surface 34*a* as a first contacting surface coming into contact with a bottom surface 42*a* of the plate 42 (FIG. 10), a ridge line 34*b* in contact with the ridge line 42*f* of the plate 42, and a surface 34*c* as a second contacting surface coming into contact with the side surface 42*e* of the plate 42.

The following is a description of an assembly operation of the developing blade member 40. In this case, a right end and a left end of the developing blade member 40 have the same structure, and therefore the left side is described while a description of the right side is omitted.

Figure 1:
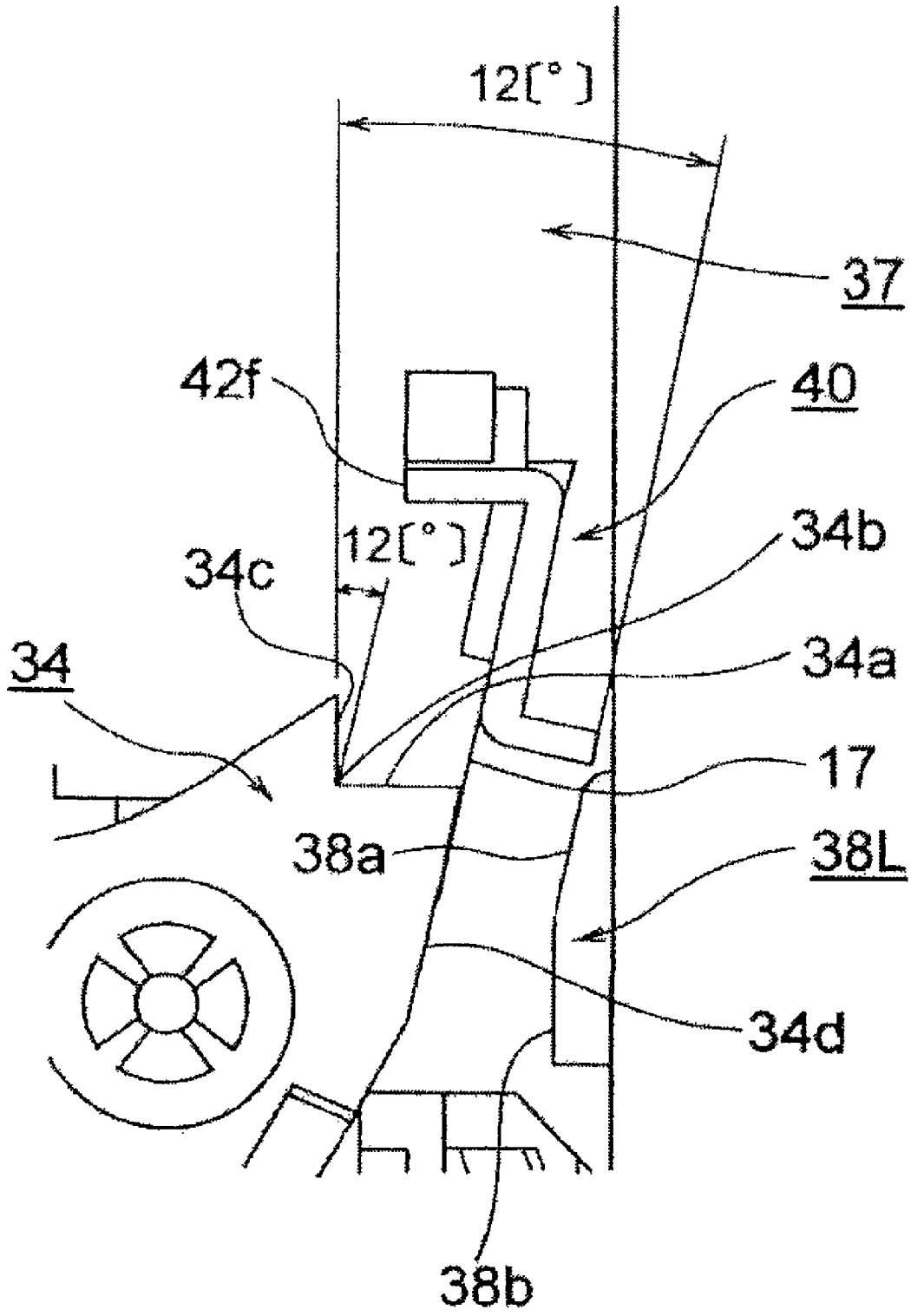
FIG. 1 is a view showing a guide arranged according to a first embodiment of the present invention.
Figure 13:
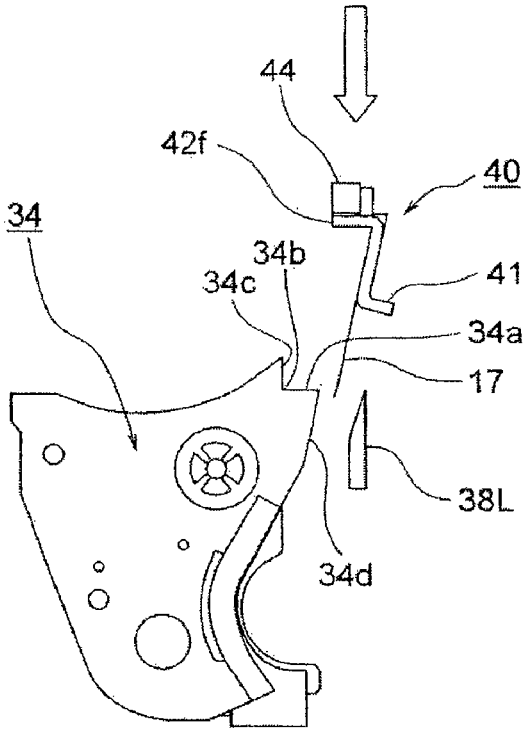
FIG. 13 is a first view showing a mounting process of the developing blade member according to the first embodiment of the present invention.
Figure 14:
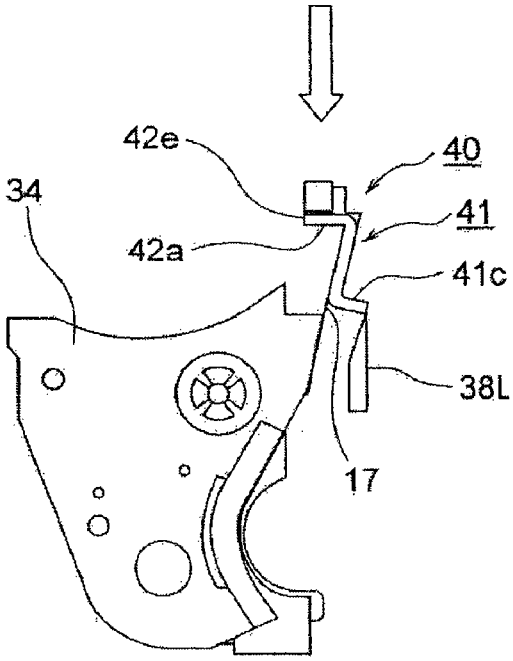
FIG. 14 is a second view showing the mounting process of the developing blade member according to the first embodiment of the present invention.
Figure 15:
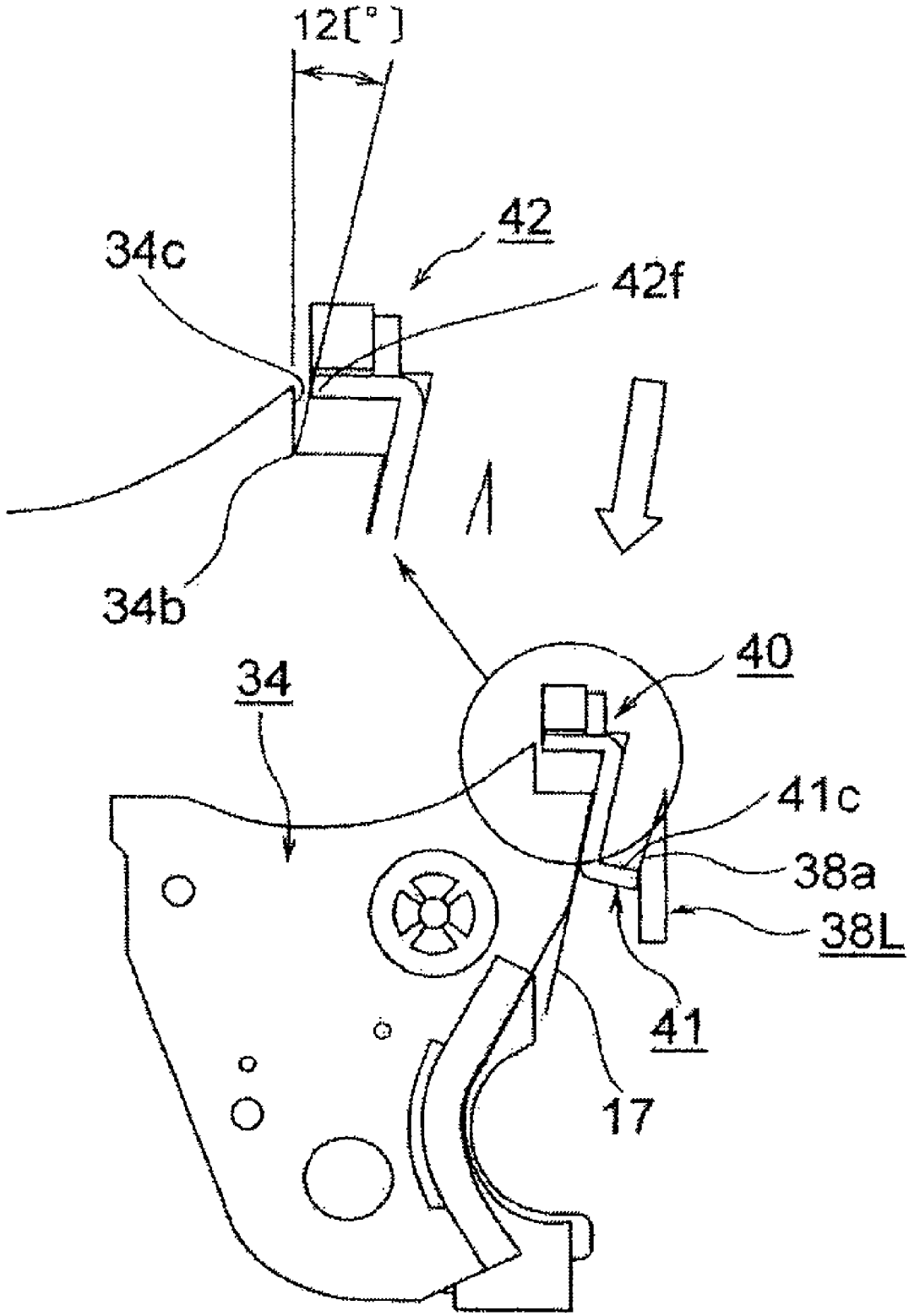
FIG. 15 is a third view showing the mounting process of the developing blade member according to the first embodiment of the present invention.
Figure 16:
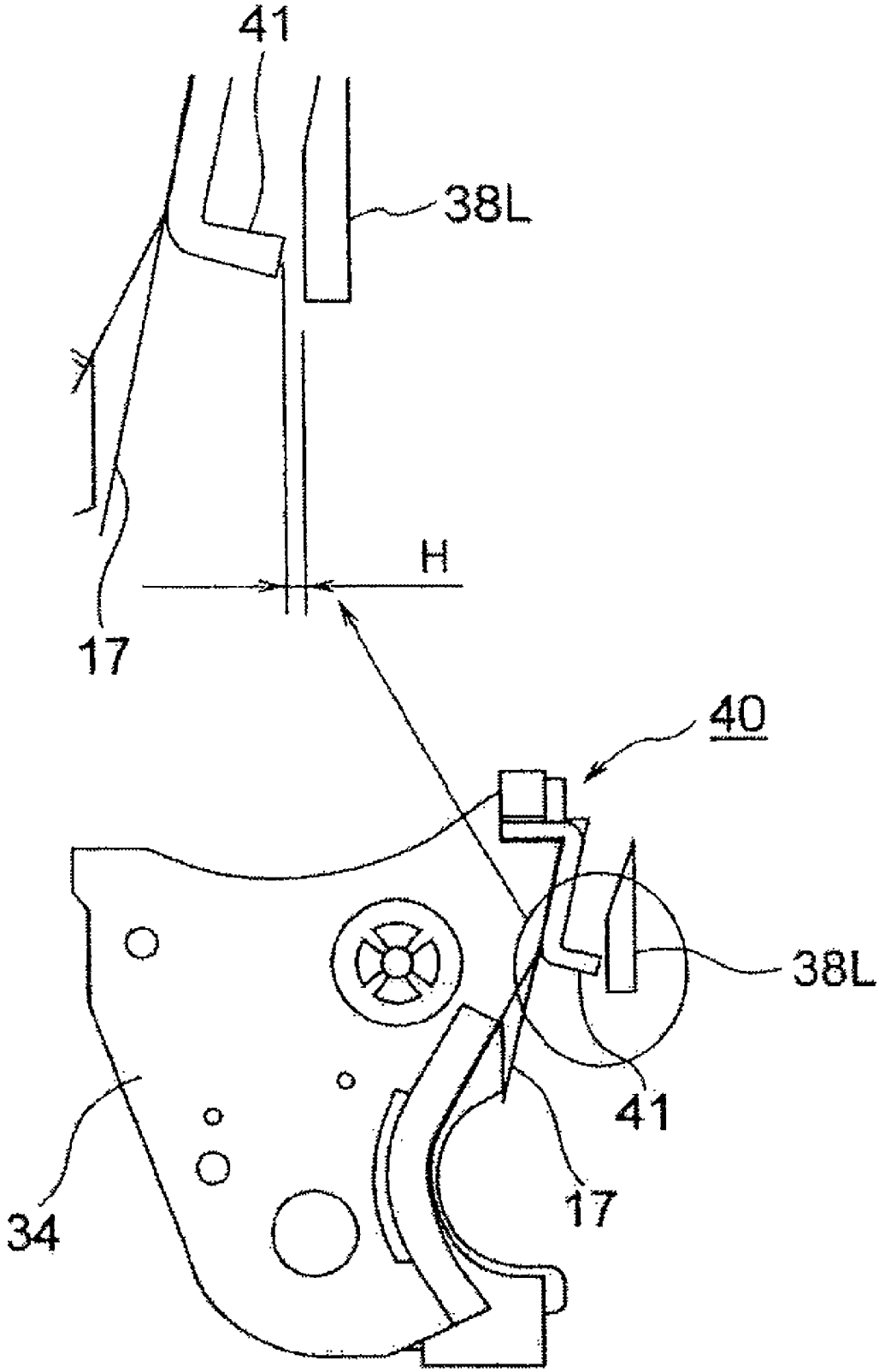
FIG. 16 is a fourth view showing the mounting process of the developing blade member according to the first embodiment of the present invention.
Figure 17:
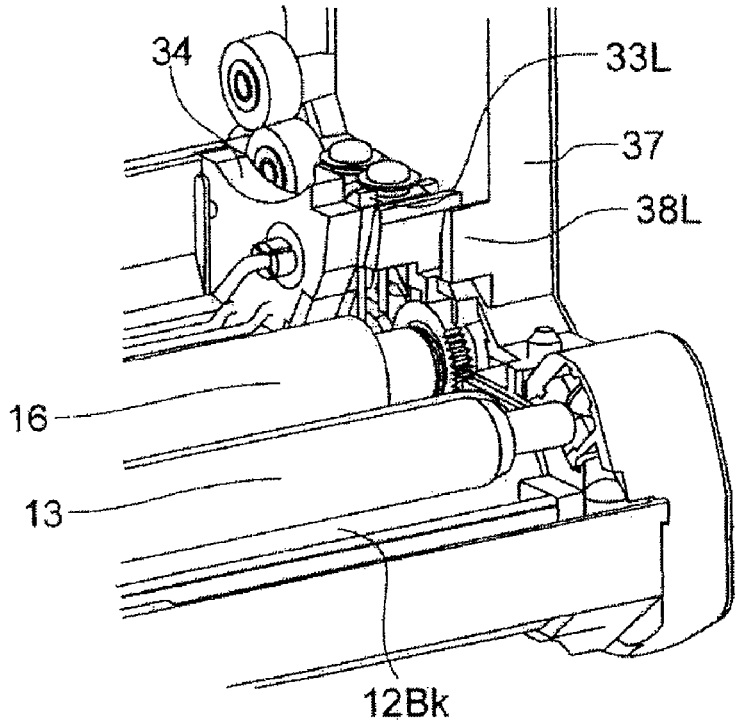
FIG. 17 is an enlarged view of the unassembled developing blade member according to the first embodiment of the present invention.
Figure 18:
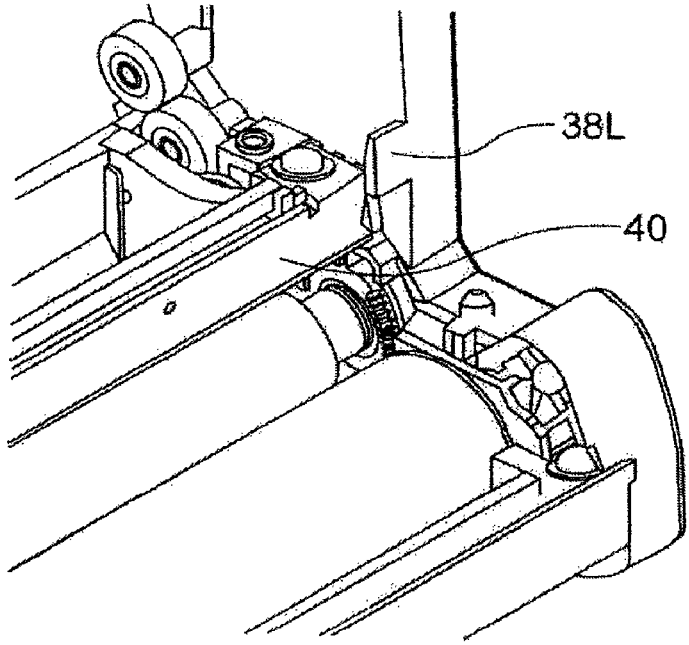
FIG. 18 is an enlarged view of the assembled developing blade member according to the first embodiment of the present invention.

FIG. 1 is a view showing an arranged condition of the guide according to the first embodiment of the present invention. FIG. 13 is a first view showing a mounting operation of the developing blade member according to the first embodiment of the present invention. FIG. 14 is a second view showing a mounting operation of the developing blade member according to the first embodiment of the present invention. FIG. 15 is a third view showing a mounting operation of the developing blade member according to the first embodiment of the present invention. FIG. 16 is a fourth view showing a mounting operation of the developing blade member according to the first embodiment of the present invention. FIG. 17 is an enlarged view of the unassembled developing blade member according to the first embodiment of the present invention. FIG. 18 is an enlarged view of the assembled developing blade member according to the first embodiment of the present invention.

As shown in FIG. 1, the guide 38L is disposed on a side facing the felt sponge 35 (FIG. 11) of the side sponge 34 in a manner to face a front surface 34*d* of the side sponge 34 with a prescribed distance therebetween. The guide 38L is formed in a projecting manner toward a side of the sealing member 32L and contains an oblique surface 38*a*, serving as a guiding surface and as a first surface formed parallel to the front surface 34*d*, and a lower straight surface 38*b* as a second surface. The oblique surface 38*a* has a prescribed angle in relation to the front surface 34*c*, which, in the case of the present embodiment, is an angle of 12 degrees. The lower straight surface 38*b* extends vertically down from a bottom portion of the oblique surface 38*a*.

Accordingly, the plate 42 can be installed at a 12 degree angle in relation to the side sponge 34 such that the ridge line 42*f* of the plate 42 is in contact with the ridge line 34*b*. In addition, numeral 17 is a developing blade, numeral 37 is a side frame, and numeral 34*a* is a surface.

In a case where the developing blade member 40 having the aforementioned structure is installed on the side sponge 34, installation begins by inserting the edge of the developing blade 17 between the front surface 34*d* of the side sponge 34 and the guide 38L, as shown in FIG. 13. The developing blade member 40 is then moved in a downward direction. Next, as shown in FIG. 14, by further moving the developing blade member 40 in a downward direction, a surface of the developing blade 17 is brought into contact with the front surface 34*d* of the side sponge 34, after which the tip of the guided unit 41*c* of the developing blade support unit 41 is brought into contact with the guide 38L.

Next, as shown in FIG. 15, with the tip of the guided unit 41*c* contacting the oblique surface 38*a* of the guide 38L, the developing blade member 40 is moved further in a downward direction, so that the ridge line 42*f* of the plate 42 is moved to have a 12 degree angle in relation to the surface 34*c* of the side sponge 34. Because the developing blade member 40 is installed on the side sponge 34 at an angle of 12 degrees, the developing blade member 40 can be installed on the side sponge 34 without having the 42*f* of the plate 42 interfere with the surface 34*c* of the side sponge 34. At this time, the developing blade member 40 is sandwiched between the guide 38L and the side sponge 34.

Next, as shown in FIG. 16, the developing blade member 40 is moved further in a downward direction, so that the bottom surface 42*d* of the plate 42 is brought into contact with the surface 34*a* of the side sponge 34, the ridge line 42*f* of the plate 42 is brought into contact with the ridge line 34*b* of the side sponge 34, and the surface 34*c* of the side sponge 34 is brought into contact with the side surface 42*c* of the plate 42. Therefore, the developing blade member 40 can be positioned with respect to the screws 43 and the developing blade member 40 can be brought into contact with the sealing units 32L, 32R (FIG. 4) at both ends, thereby reliably sealing the storage chamber 20 (FIG. 3).

At a time when installation of the developing blade member 40 on the side sponge 34 is complete, the guide 38L is formed having a gap H between the developing blade support unit 41 and the guide 38L, as shown in FIG. 16. In the present embodiment, the gap H is set to be 1 mm. The gap H is necessary because without the gap H, a burden would be placed on the developing blade member 40 and there would be a possibility that the sealing strength of the sealing units 32L, 32R could be decreased.

In the manner described above, the developing blade member 40 as shown in FIG. 18 can be disposed in the developing device such as that shown in FIG. 17.

In the present embodiment, the developing blade member 40 is set at an installation angle of 12 degrees in relation to the side sponge 34, but it is not absolutely necessary that this angle be 12 degrees, and may be changed within a suitable ranged. The following is an explanation of the range at which the angle of the developing blade 40 can be set in relation to the side sponge 34 at the time of assembly.

Figure 19:
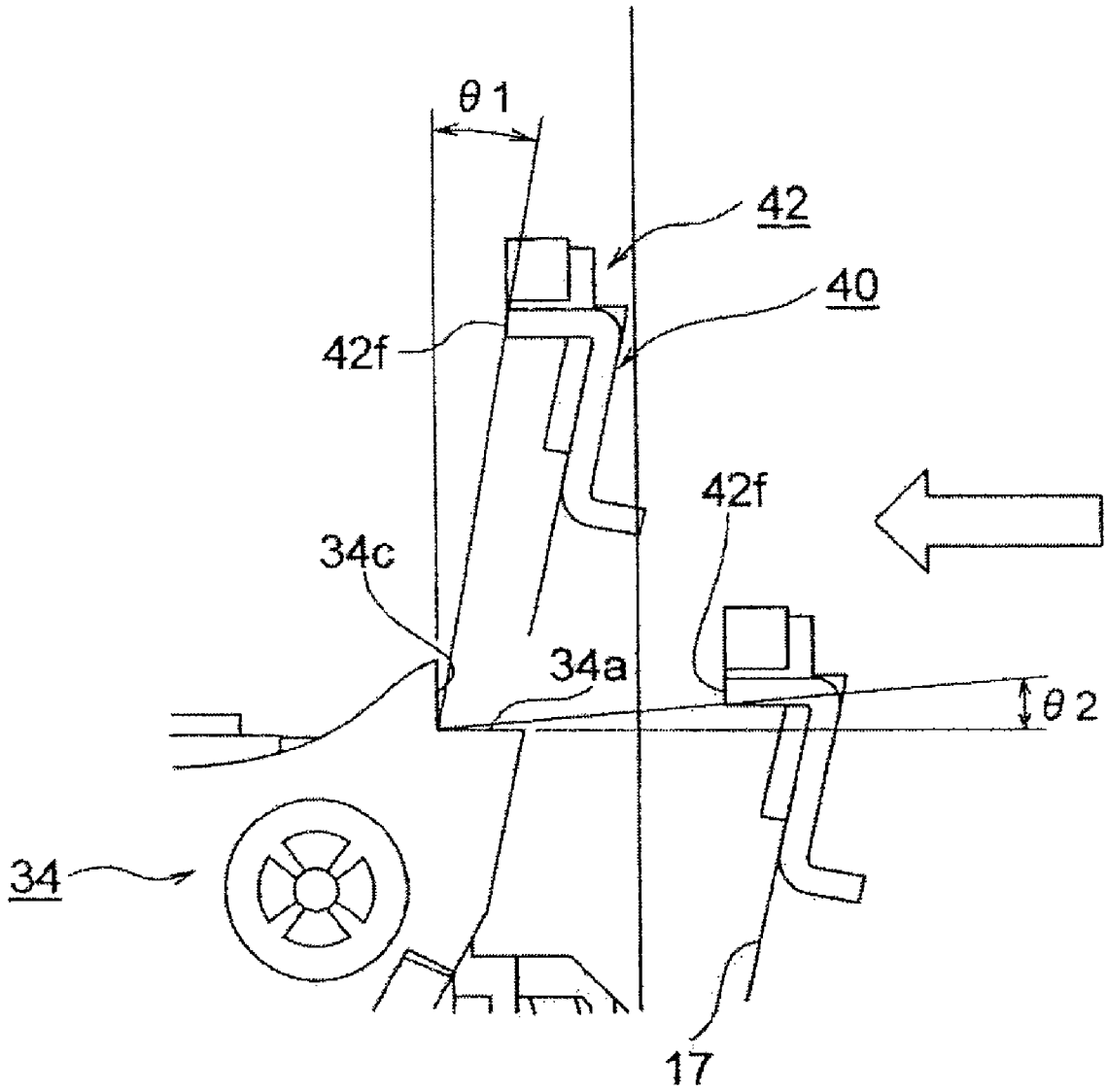
FIG. 19 is a view explaining the angle of the developing blade member in relation to the side sponge according to the first embodiment of the present invention.

FIG. 19 is a view explaining the angle of the developing blade 40 in relation to the side sponge 34 according to the first embodiment of the present invention.

As shown in FIG. 19, the angle at which the surface 34*c* of the side sponge 34 can interfere with the developing blade member 40 is set as $\theta 1$ and the angle at which the surface 34*a* of the side sponge 34 can interfere with the developing blade member 40 is set as $\theta 2$. In consideration of the measurement accuracy of the side sponge 34, each of $\theta 1$ and $\theta 2$ can be set to 5 degrees. That is, values of $\theta 1=5$ degrees and $\theta 2=5$ degrees are set.

In a case such as in the present embodiment where the developing blade member 40 comes into contact with the side sponge 34 on two surfaces, namely surfaces 34*a*, 34*c*, it is preferable to set the installation angle to be within a range of an internal angle $\theta$, where $\theta$ is the angle made by the surfaces 34*a*, 34*c* of the side sponge 34, but not such that the installation angle falls within $\theta 1$ or $\theta 2$.

In other words, where the installation angle is set as $\alpha$, the installation angle $\alpha$ is set such that $\theta 1 \leqq \alpha \leqq \theta - \theta 2$. Where $\theta$ is 5 degrees as in the present embodiment, the installation angle $\alpha$ is set such that 5 degrees$\leqq \alpha \leqq \theta - 5$ degrees.

Accordingly, the angle of the oblique surface 38*a* of the guide 38L (FIG. 15) in relation to the surface 34*c* is set to be equal to the installation angle α.

In the present embodiment, by arranging the guides 38L, 38R on the side frames 36, 37 in the manner described above, the installation direction of the developing blade member 40 can be controlled, so that variations in an installation method by operators can be prevented.

Furthermore, by controlling the installation direction, curling of the sealing units 32L, 32R (FIG. 4), and particularly curling of the edge of the side sponge 34, caused by the edge of the plate 42 of the developing blade member 40 can be prevented. Accordingly, the gap between the developing blade member 40 and the sealing units 32L, 32R can be prevented, thereby preventing toner leakage. In addition, numeral 17 is the developing blade and numeral 42*f* is the ridge line.

Second Embodiment

The following is a description of a second embodiment of the present invention. Parts having the same structure as those of the first embodiment are given the same number, and a description thereof is omitted. Furthermore, the effect of the invention having the same structure is the same in the embodiments having the same structure.

Figure 20:
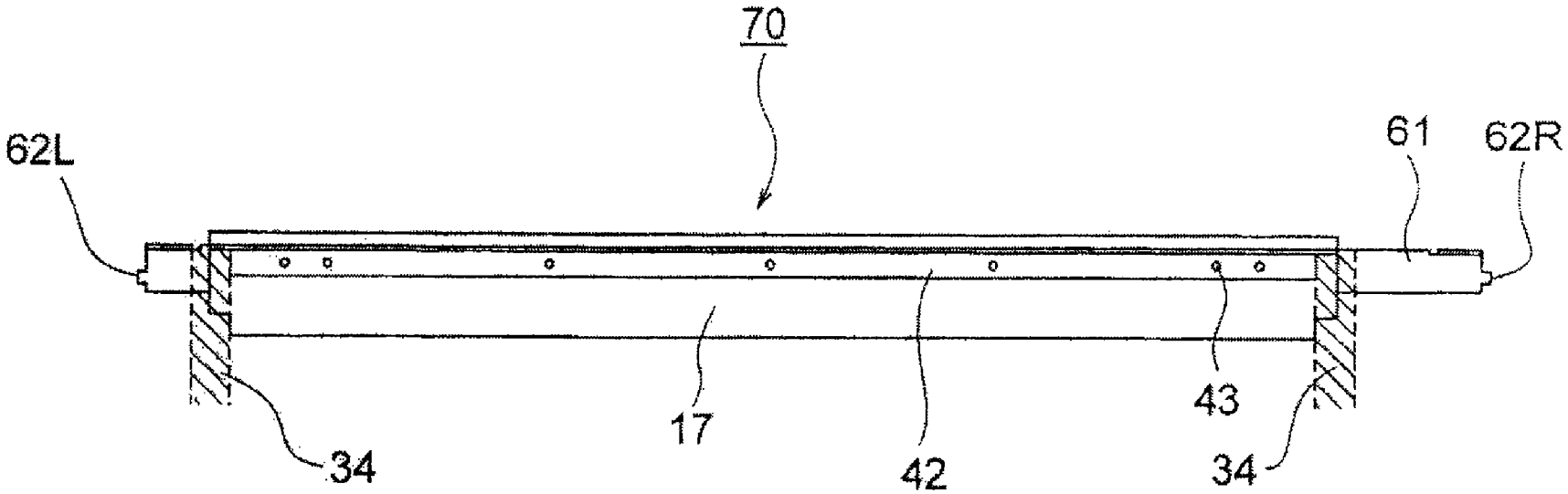
FIG. 20 is an elevational view of the developing blade member according to a second embodiment of the present invention.

FIG. 20 is a front view of the developing blade member according to the second embodiment of the present invention.

In the second embodiment, protruding units 62L, 62R, serving as control members, are formed in a united manner at a left and right of both ends of a development blade support unit 61 of a developing blade member 70.

Figure 21:
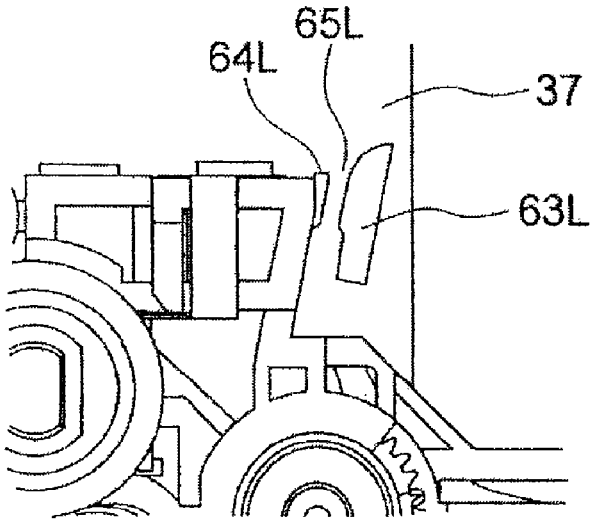
FIG. 21 is a cross-sectional view of a guide disposed on a left side according to the second embodiment of the present invention.
Figure 22:
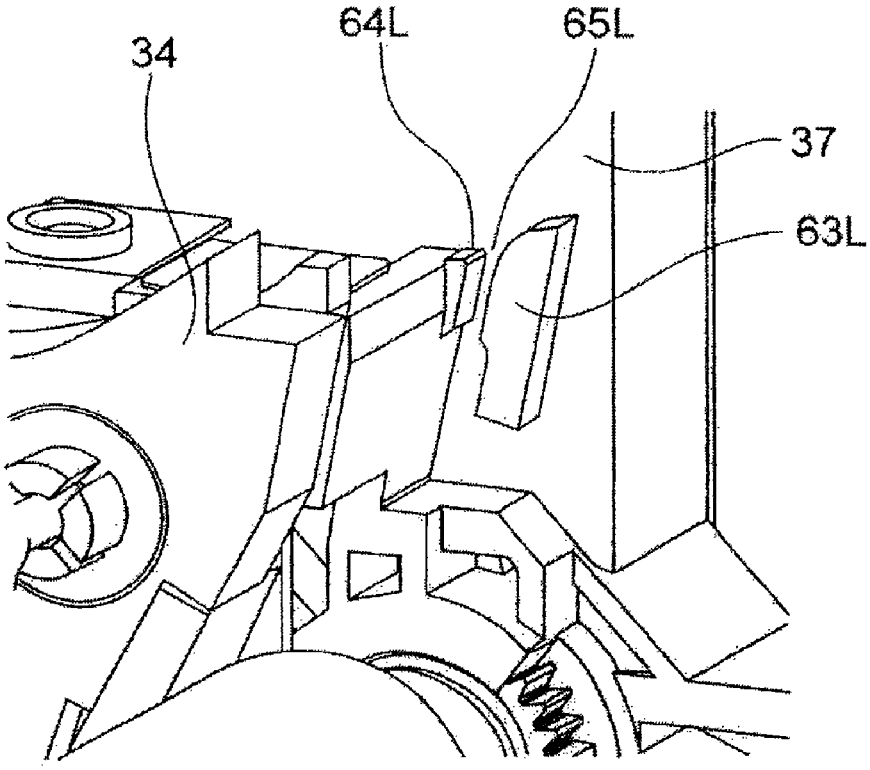
FIG. 22 is a perspective view showing the guide disposed on the left side according to the second embodiment of the present invention.
Figure 23:
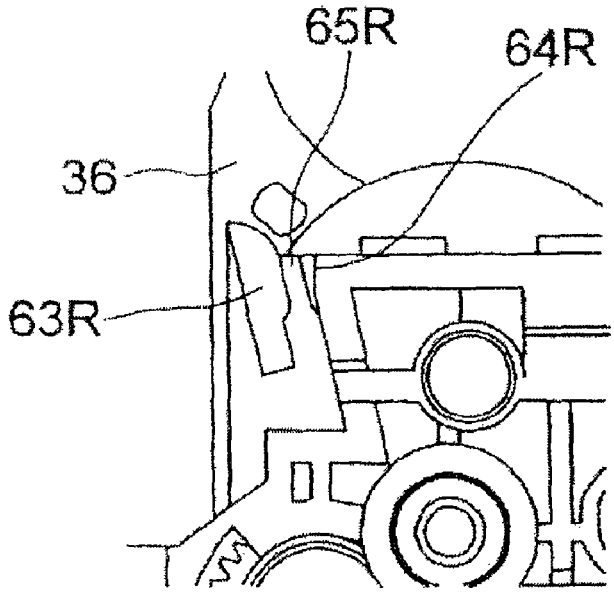
FIG. 23 is a cross-sectional view showing the guide disposed on a right side according to the second embodiment of the present invention.

FIG. 21 is a cross-sectional view showing the guide disposed on a left side according to the second embodiment of the present invention. FIG. 22 is a perspective view showing the guide disposed on the left side according to the second embodiment of the present invention. FIG. 23 is a cross-sectional view showing the guide disposed on a right side according to the second embodiment of the present invention.

On the right side, as shown in FIGS. 21 and 22, a gap 65L is formed between the guides 63L, 64L serving as guiding units formed on the side frame 37 at a prescribed installation angle. In the second embodiment, the installation angle and an angle of a guiding surface of the guides 63L, 64L are set to be 12 degrees.

On the right side, as shown in FIG. 23, a gap 65R is formed between the guides 63R, 64R serving as guiding units formed on the side frame 36 at a prescribed installation angle. In the second embodiment, in the same manner as the left side, the installation angle and an angle of a guiding surface of the guides 63R, 64R are set to be 12 degrees. The guides 63L, 64L, 63R, 64R are structured to serve as direction control members controlling the installation direction of the developing blade member 70 at a time when the developing blade member 70 is installed on the side sponge 34 serving as an elastic sealing member.

Figure 24:
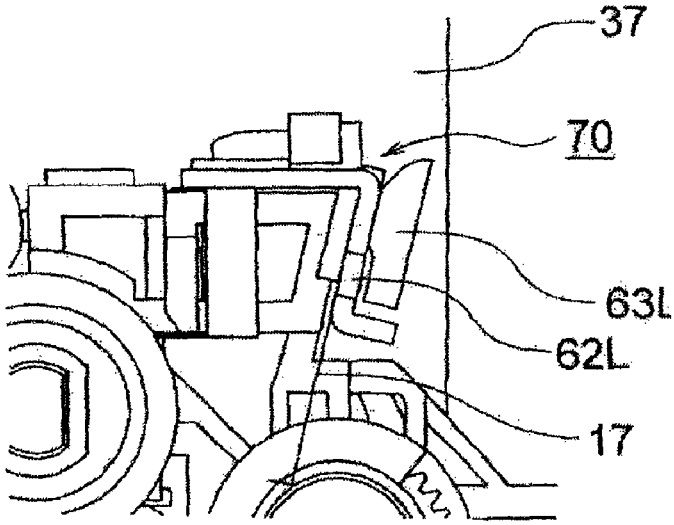
FIG. 24 is a cross-sectional view of the developing blade unit mounted on the left side according to the second embodiment of the present invention.
Figure 25:
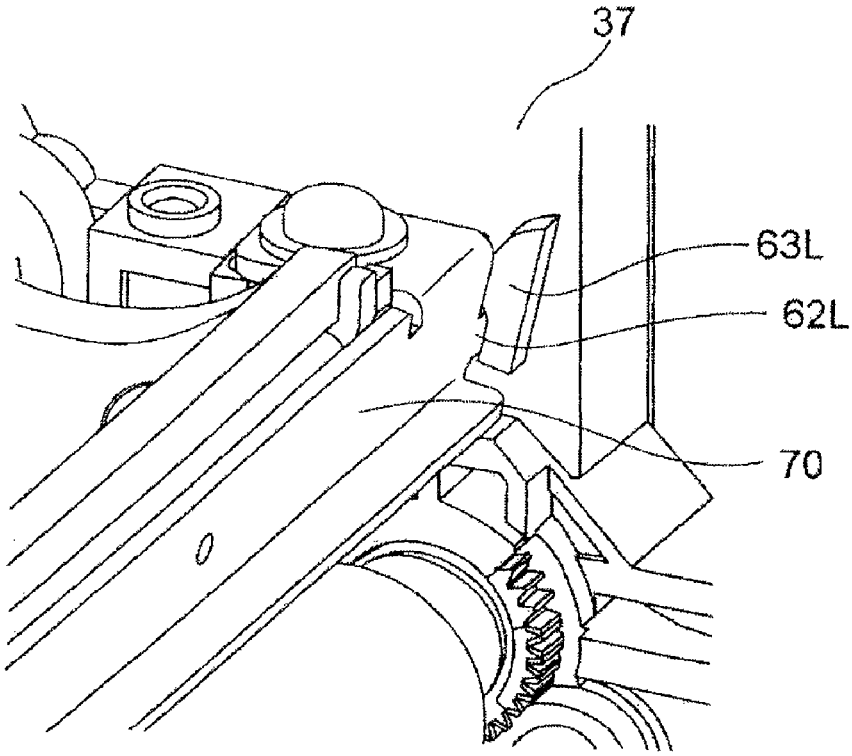
FIG. 25 is a perspective view of the developing blade unit mounted on the left side according to the second embodiment of the present invention.
Figure 26:
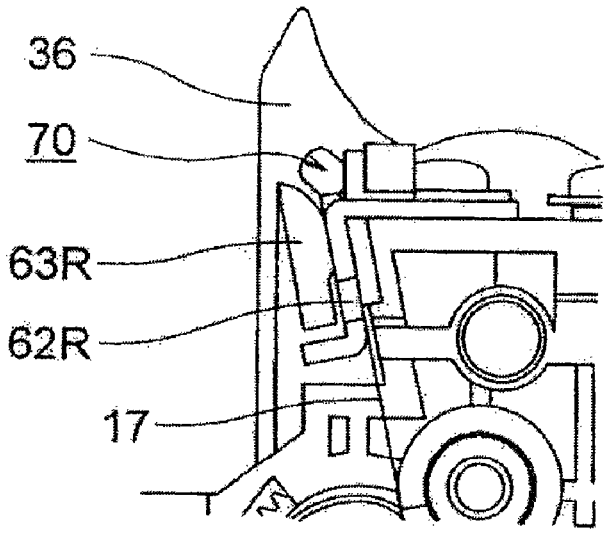
FIG. 26 is a cross-sectional view of the developing blade unit mounted on the right side according to the second embodiment of the present invention.

FIG. 24 is a cross-sectional view of the developing blade unit mounted on the left side according to the second embodiment of the present invention. FIG. 25 is a perspective view of the developing blade unit mounted on the left side according to the second embodiment of the present invention. FIG. 26 is a cross-sectional view of the developing blade unit mounted on the right side according to the second embodiment of the present invention.

On the left side, as shown in FIGS. 24 and 25, the developing blade member 70 is mounted on the side frame 37. On the right side, as shown in FIG. 26, the developing blade member 70 is mounted on the side frame 36.

The following is a description of steps for installing the developing blade member 70 having the aforementioned structure.

Figure 27:
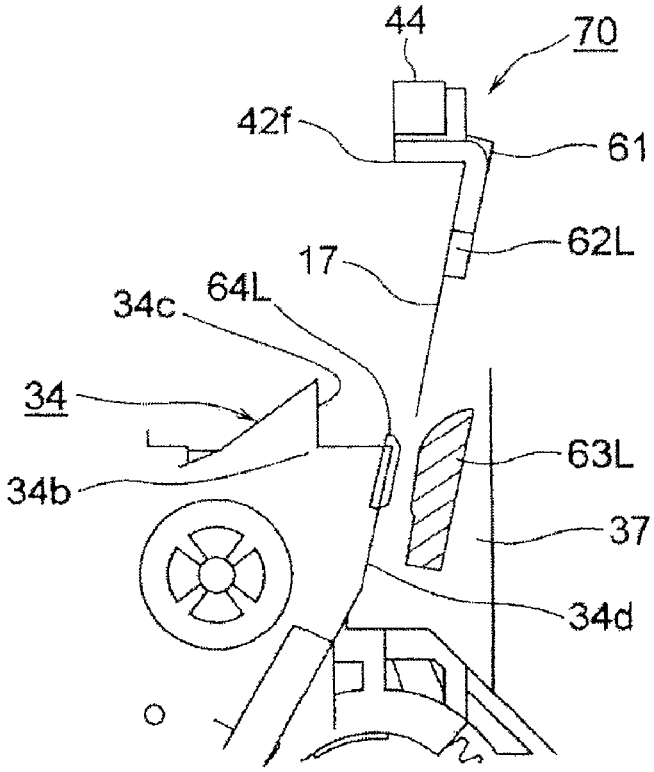
FIG. 27 is a first view showing a mounting process of the developing blade member according to the second embodiment of the present invention.
Figure 28:
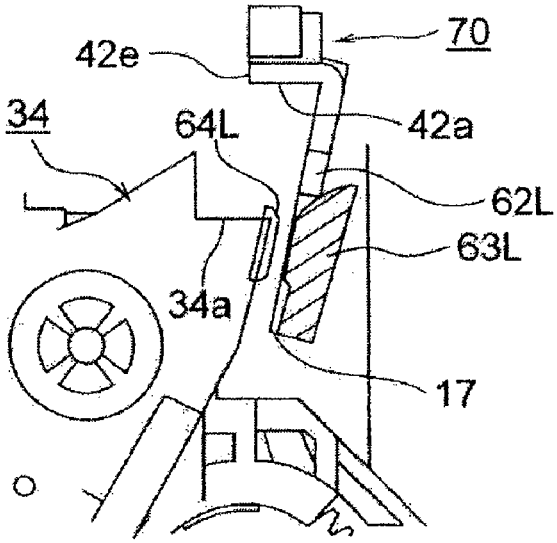
FIG. 28 is a second view showing the mounting process of the developing blade member according to the second embodiment of the present invention.
Figure 29:
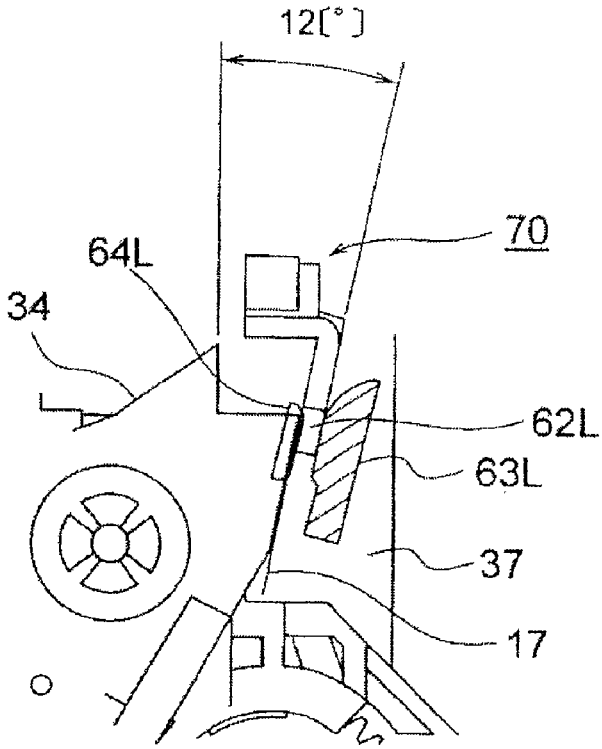
FIG. 29 is a third view showing the mounting process of the developing blade member according to the second embodiment of the present invention.
Figure 30:
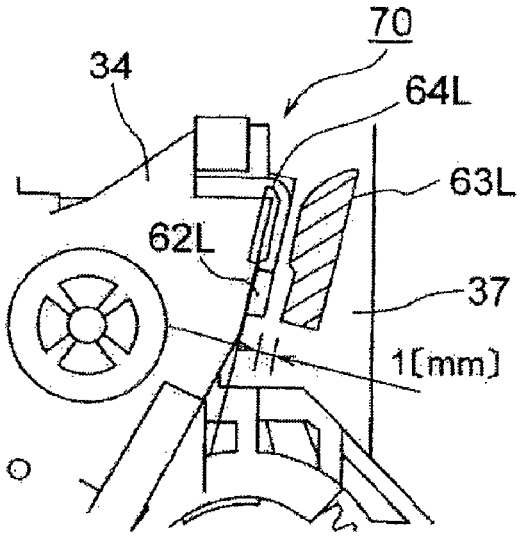
FIG. 30 is a fourth view showing the mounting process of the developing blade member according to the second embodiment of the present invention.

FIG. 27 is a first view showing a mounting operation of the developing blade member according to the second embodiment of the present invention. FIG. 28 is a second view showing a mounting operation of the developing blade member according to the second embodiment of the present invention. FIG. 29 is a third view showing a mounting operation of the developing blade member according to the second embodiment of the present invention. FIG. 30 is a fourth view showing a mounting operation of the developing blade member according to the second embodiment of the present invention.

In the second embodiment, the developing blade member 70 is installed from an upward direction.

First, as shown in FIG. 27, the developing blade member 70 is moved such that the protruding unit 62L formed on an edge of the developing blade support unit 61 contacts the guide 63L, as shown in FIG. 28. At this time, interference is avoided because the distance between the edge of the developing blade 17 and the guides 63L, 64L is greater than the distance between the protruding unit 62L formed on the edge of the developing blade support unit 61 and the side frame 37.

Next, as shown in FIG. 29, the protruding unit 62L is guided by the furrow 65L (FIG. 22) between the guides 63L, 64L. The angle at which the protruding unit 62L is guided by the furrow 65L is 12 degrees, and at this time, the developing blade 17 does not come into contact with the front surface 34*d* of the side sponge 34 because the guide 64L is formed on the front surface 34*d* of the side sponge 34 facing the guide 63L.

Next, as shown in FIG. 30, installation of the developing blade member 70 is complete, but the protruding unit 62L does not contact the guides 63L, 64L, so that the installed developing blade member 70 is not controlled by the guides 63L, 64L. According to the second embodiment, the gap between the protruding unit 62L and the guide 63L is set to 1 mm.

Therefore, in the second embodiment, because the guides 63R, 64R are arranged at two locations on the side frame 36 and the guides 63L, 64L are arranged at two locations on the side frame 37, the developing blade member 70 can be installed on the side sponge 34 without having the developing blade 17 come into contact with the front surface 34*d* of the side sponge 34. Accordingly, curling of the sealing units 32L, 32R, and particularly curling of the edge of the side sponge 34, caused by the edge of the plate 42 of the developing blade member 70 can be prevented. Therefore, the gap between the developing blade member 70 and the sealing units 32L, 32R can be prevented, thereby preventing toner leakage.

Furthermore, the developing blade member 70 can be installed simply by being pushed between the guides 63L, 64L and the guides 63R, 64R, thereby increasing operating efficiency.

The aforementioned embodiments are described as applicable to a printer serving as an image forming apparatus, but the present invention is not limited to this and my also be applied to a photocopier, a facsimile machine, a multifunction device, or the like.

The foregoing description of preferred embodiments of the invention has been presented for purposes of illustration and description, and is not intended to be exhaustive or to limit the invention to the precise form disclosed. The description was selected to best explain the principles of the invention and their practical application to enable others skilled in the art to best utilize the invention in various embodiments and various modifications as are suited to the particular use contemplated. It is intended that the scope of the invention should not be limited by the specification, but be defined by the claims set forth below.

What is claimed is:

1. A developing device comprising:

a developer carrier for executing developing by affixing developer to an image carrier;

a restricting section disposed in contact with said developer carrier for thinning a layer of developer;

a restricting mechanism having the restricting section and a support section supporting said restricting section, wherein an edge of the restricting section is engaged with the support section;

an elastic sealing section that includes a contact surface contacting said support section and disposed on an edge side in a longitudinal direction of said restricting section, a first surface extending in an installation direction of the restriction section and contacting the restricting section, and a notch having a second surface arranged in a direction substantially transverse to the first surface and configured to engage a part of the support section arranged on an edge side of the restricting section preventing the restricting section from being inserted more than a predetermined amount; and a guiding section for restricting the installation direction of said restricting mechanism at a time when said restricting mechanism is mounted on said elastic scaling section, provided with a guiding surface formed at a prescribed angle in relation to said contact surface of said elastic scaling section, wherein said guiding section is arranged with respect to said elastic sealing section to form a gap for installing said restricting mechanism, and wherein said guiding section extends toward the installation direction of said restricting mechanism, the guiding section including a guiding surface extended at a prescribed angle and a surface extending at a different angle from said guiding surface.

2. The developing device according to claim 1, wherein said guiding section is formed in a manner such that an angle of said support section is greater than or equal to five degrees in relation to said contact surface of said sealing section.

3. An image forming apparatus including said developing device described in claim 2.

4. The developing device according to claim 1, wherein an angle of said support section is set greater than or equal to five degrees in relation to each contact surface in a case where said elastic sealing section has a plurality of contact surfaces.

5. An image forming apparatus including said developing device described in claim 4.

6. The developing device according to claim 1, wherein:

a pair of said guiding section are arranged facing each other; and each guiding section guides both surfaces of said restricting section.

7. An image forming apparatus including said developing device described in claim 6.

8. An image forming apparatus including said developing device described in claim 1.

9. The developing device according to claim 1, wherein an end of said support section is in contact with the notch of said elastic sealing section, and wherein the other end of said support section is in contact with said guiding section.

10. The developing device according to claim 9, wherein said supporting section includes:

a first member extending toward the installation direction of said restricting mechanism, and second and third members extending in a direction substantially perpendicular to the installation direction from the first member, and wherein the second member is in contact with the notch of said elastic sealing section and the third member is in contact with the first member.

11. The developing device according to claim 1, wherein the notch further includes a third surface extending from the second surface in a substantially opposite direction as the installation direction of the restricting section to restrict the restricting section from moving in a direction substantially perpendicular to the installation direction by engagement of the third surface with a part of the support section.

12. The developing device according to claim 11, wherein the third surface interferes with installation of the restricting mechanism at a prescribed angle.

* * * * *